United States Patent [19]

Harbers, Jr.

[11] 4,368,364

[45] Jan. 11, 1983

[54] KEY MECHANISM

[75] Inventor: H. C. Harbers, Jr., San Marino, Calif.

[73] Assignee: Load Cells Inc., South El Monte, Calif.

[21] Appl. No.: 212,574

[22] Filed: Dec. 3, 1980

[51] Int. Cl.[3] ..... H01H 3/00; G10C 3/12

[52] U.S. Cl. ..... 200/6 R; 84/DIG. 7; 84/433; 200/339

[58] Field of Search ..... 84/343, 344, 345, 423 R, 84/423 A, 433, 434, 435, DIG. 7; 200/339, 6 R

[56] References Cited

U.S. PATENT DOCUMENTS 3,417,649 12/1968 Wood ..... 84/433
3,797,357 3/1974 Thomas et al. ..... 84/343
3,845,683 11/1974 Lehmann ..... 84/DIG. 7
3,855,894 12/1974 Thomas et al. ..... 84/433 X
4,173,166 11/1979 Koepke ..... 84/343

*Primary Examiner*—J. R. Scott
*Attorney, Agent, or Firm*—William W. Haefliger

[57] ABSTRACT

A key device, as used in a keyboard, comprises
(a) a hinge,
(b) a key tab projecting in one direction relative to the hinge, and connected with the hinge,
(c) a pusher projecting in another direction relative to the hinge, and connected with the hinge, and
(d) a spring arranged to be deflected when the key tab is downwardly depressed about the hinge axis, to resist such depression.

11 Claims, 8 Drawing Figures

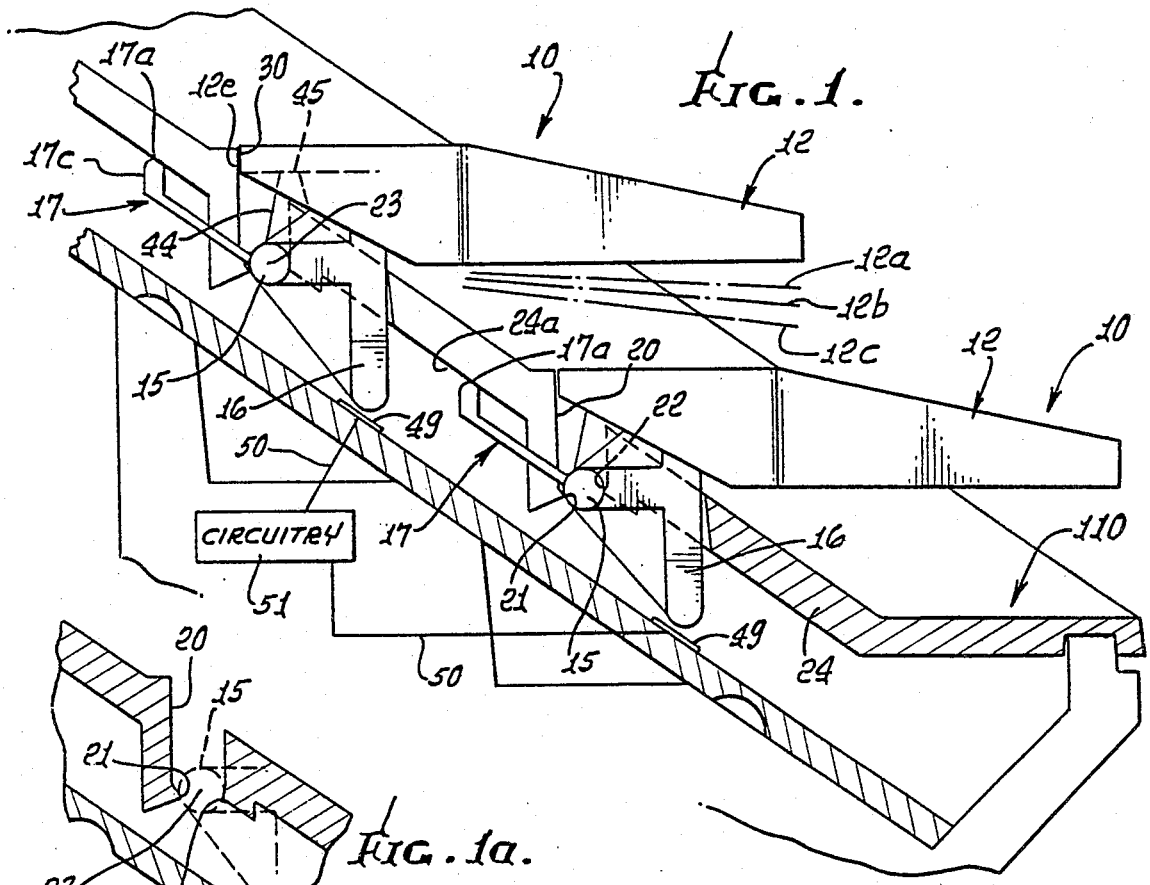
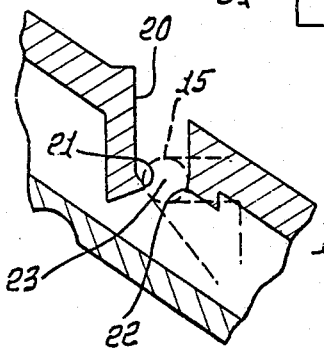
FIG. 1a.
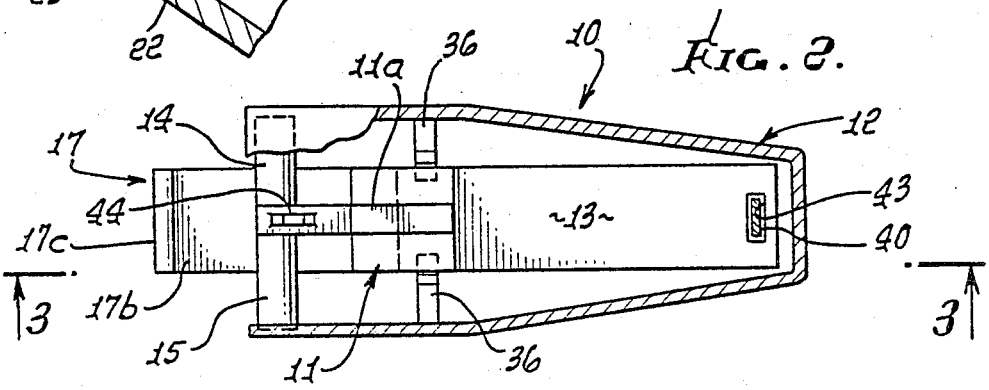
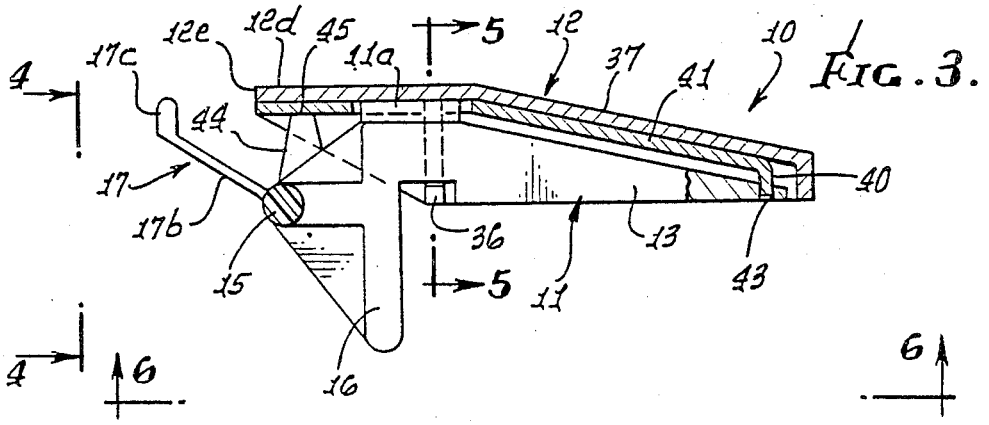

KEY MECHANISM

BACKGROUND OF THE INVENTION

This invention relates generally to key devices as are used in keyboards. More specifically it concerns a significantly improved key construction with unusual advantages as will appear.

In keyboard apparatus there are constant needs for improved key devices. Among such needs are improved and simplified key construction facilitating ease of fabrication, higher reliability, ease of operation (as for example "touch" functioning) and replaceability. Other needs also exist.

SUMMARY OF THE INVENTION

It is a major object of the invention to provide a key device meeting the above needs. Basically, the device comprises:

(a) a hinge, (b) a key tab projecting in one direction relative to the hinge, and connected with the hinge, (c) a pusher projecting in another direction relative to the hinge, and connected with the hinge, and (d) a spring arranged to be deflected when the key tab is downwardly depressed about the hinge axis, to resist such depression.

As will appear, the hinge, pusher, and spring are typically part of an integrally molded plastic unit, which may also include a support for the key tab, characterized as facilitating removal and replacement of the tab. To this end, the support and tab may have releasable snap-interconnection as facilitated by tongue and groove interconnection.

Further, the key tab may define a stop engageable with housing structure to limit upward pivoting of the tab about the hinge axis, and so as to pre-tension the spring. The latter may project forwardly from the body of the unit, and in the form of a flat spring, to engage the underside of the housing wall or panel. Pre-tensioning means for the snap-interconnected support and key tab may also be provided.

These and other objects and advantages of the invention, as well as the details of an illustrative embodiment, will be more fully understood from the following description and drawings, in which:

DRAWING DESCRIPTION

FIG. 1 is a side elevation showing the key device of the invention, installed on a housing;

FIG. 1*a* is a side elevation showing a socket to receive hinge trunnions carried by the key device;

FIG. 2 is a bottom plan view of the key device;

FIG. 3 is a section on lines 3—3 of FIG. 2;

DETAILED DESCRIPTION

Figure 4:
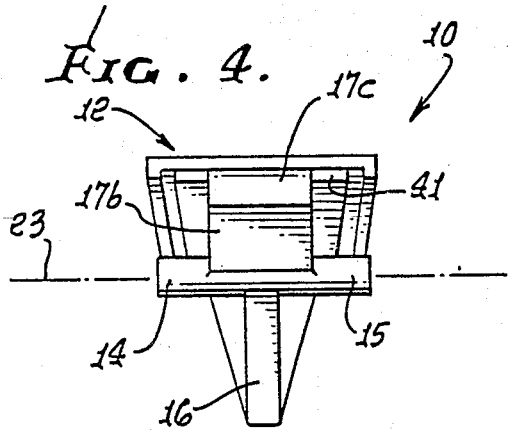
FIG. 4 is an end elevation on lines 4—4 of FIG. 3.
Figure 5:
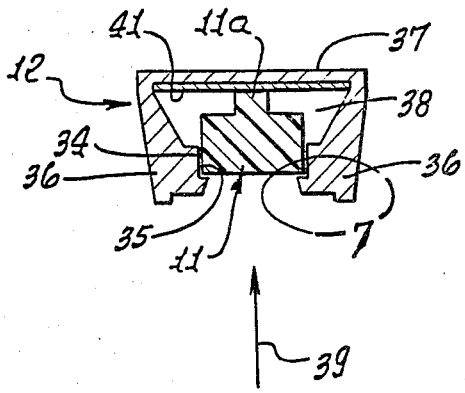
FIG. 5 is a section taken in section on lines 5—5 of FIG. 3.

In FIGS. 1 and 2 key devices 10 are shown as carried by housing structure 110. The device 10 is better shown in FIGS. 2–7 as including a molded plastic body 11, and a key tab 12 associated with the body. The tab 12 projects in one direction (for example rightwardly in FIGS. 2 and 3) relative to the body 11, and is carried by a rightwardly elongated support 13 integral with the body.

Also integral with the body 11, so as to form a unit, are a hinge in the form of trunnions 14 and 15; a downwardly projecting pusher 16, and a spring 17 arranged to be resiliently deflected when the key tab is downwardly depressed (see broken lines 12*a*, 12*b* and 12*c* in FIG. 1), to resist such downward deflection. Thus, elements 11, 13, 14, 15, 16 and 17 are typically part of a single, integrally molded plastic unit, and project in different directions so as to function optimally without interfering with one another. Ease of molding of the unit is also facilitated.

Figure 6:
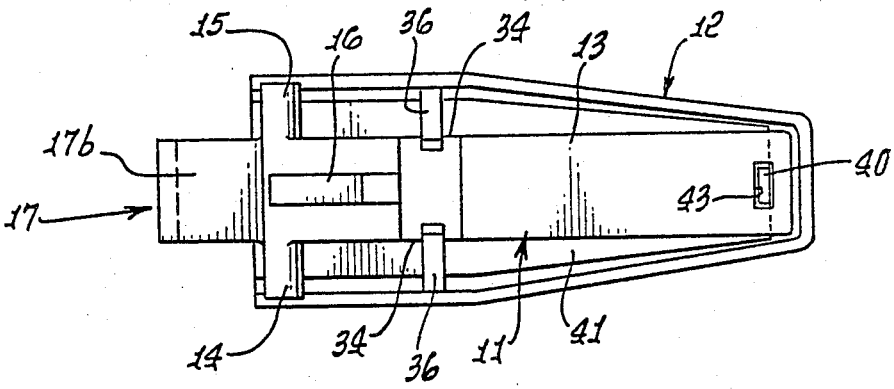
FIG. 6 is a bottom plan view on lines 6—6 of FIG. 3.
Figure 7:
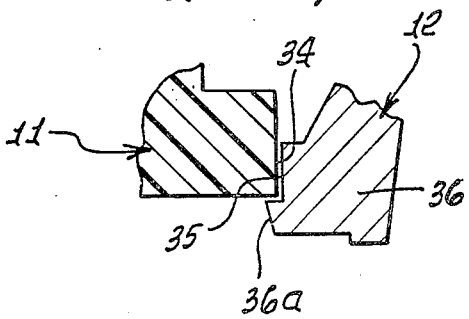
FIG. 7 is an enlarged section taken as indicated at 7 in FIG. 5.

More specifically, the cylindrical hinge trunnions 14 and 15 project oppositely as seen in FIGS. 2 and 6, and are receivable in sockets carried by the housing structure 11. As shown in FIGS. 1 and 1*a*, the trunnions are received downwardly in socket slots 20, and nest against socket edges 21 and 22 which extend slightly beneath opposite sides of the trunnions to provide low-friction supports for trunnion rotation. The trunnion common axis 23 then typically extends horizontally. In this configuration, the housing leftwardly and upwardly inclined wall 24 defines an undersurface 24*a* engageable by the tip 17*a* of spring 17 so that the trunnions are urged or maintained in downwardly seated positions against edges 21 and 22. To this end, the flat cantilever spring 17 extends generally leftwardly at 17*b* and upwardly at 17*c* relative to the hinge trunnions, whereby the spring resiliently resists counterclockwise movement of the key device as the key tab is depressed.

The key tab 12 has a forward end portion 12*d* spaced generally above the hinge, and defining a stop 12*e* engaged against the housing structure, at shoulder 30. This interengagement limits upward pivoting of the key tab, and maintains flat spring 17 slightly deflected, i.e. "tensioned".

The key tab 12 and support 13 typically have releasable interconnection, whereby the key tab is secured to the support and it is also easily removed for cleaning or replacement. To this end, the interconnection may include first tongue and groove elements proximate a juncture of the support 13 with a medial portion of the unit, as well as second tongue and groove elements proximate an end of the support remote from the pusher 16 and trunnions 14 and 15. As shown, the first tongue and groove elements take the form of tongue edges 34 (see FIGS. 5 and 7) of body 11 that snap into recesses or grooves 35 in the flanges 36 integral with and depending from the key tab upper plate 37. Flanges 36 have cam surfaces 36*a* that taper in the direction of body and support 13 insertion relatively into the recess 38 formed by the key tab. See arrow 39 in FIG. 5. When the body and support are fully received into recess 38, the flanges 36, that were resiliently spread apart during such insertion, snap back toward one another to releasably hook the key tab onto the body 11 and support 13. To remove the key tab for replacement, the flanges 36 are manually spread apart, and the tab lifted. See FIGS. 5 and 6 in this regard.

The second elements take the form, as shown, of downwardly projecting tongue or lip 40 on an insert or spacer 41 retained adjacent the underside of plate 37. Insert 41 may be considered as part of key tab 12. The groove 43 is formed in the support 13 to fit the lip 40 as the key tab is assembled downwardly on the support 13, as is clear from FIG. 3. During assembly, the lip and groove 40 and 43 are first interengaged to define a pivot, and then the key tab is pressed down in the support to snap-connect these parts as the elements 34 and 35 interconnect, providing very easy and quick assembly.

The interconnection at tongue and groove 34 and 35 is "tensioned" as by providing a projection 44 integral with the body 11 near the hinge trunnions, and projecting upwardly (see FIGS. 1 and 3) to engage the underside of the key tab insert 41 at locus 45. Body top 11*a* also engages insert 41.

The downwardly projecting pusher is downwardly displaced, in response to downward depression of the key tab 12 in FIG. 1, to engage a circuit element 49. The latter is connected at 50 with circuitry 51 so that a signal is passed to the latter when the element 49 is engaged or approached by the contact 16. Element 49 may take any of various forms, such as a switch contact, capacitor plate, etc.

I claim:

1. In a key device to be carried by housing structure, (a) a hinge adapted to be supported by said housing structure, (b) a key tab projecting relatively rearwardly relative to the hinge, and connected with the hinge, (c) a pusher operatively connected with the hinge to extend downwardly in rearwardly spaced relation to the hinge, for movement toward and engagement with a circuit element, (d) a spring operatively connected with and projecting forwardly of the hinge below the key tab and confined by the housing structure to be deflected when the key tab is downwardly depressed about the hinge axis, to resist such depression.

2. The key device of claim 1 in which the hinge, pusher and spring are part of an integrally molded unit.

3. The key device of claim 2 including a support integral with said unit and extending in the direction of the key tab, the key tab carried by the support, the spring projecting in spaced relation to an end of the key tab.

4. The key device of claim 3 wherein the key tab and said unit have a releasable interconnection.

5. The key device of claim 4 wherein said interconnection includes first tongue and groove elements proximate a medial portion of said unit.

6. The key device of claim 5 wherein said interconnection includes a lip on an insert adjacent the key tab and a groove in said support remote from said pusher and hinge.

7. The key device of claim 1 wherein said spring is a flat spring that projects relatively forwardly and upwardly.

8. The key device of claim 3 wherein the key tab has a forward end portion overhanging and spaced from the hinge, and defining a stop to abut an exposed shoulder of the housing structure to limit upward pivoting of the key tab.

9. The key device of claim 4 wherein said unit includes an integral projection engageable with the key tab to tension said tongue and groove interconnection.

10. In a key device, (a) a hinge, (b) a key tab projecting in one direction relative to the hinge, and connected with the hinge, (c) a pusher projecting in another direction relative to the hinge, and connected with the hinge, (d) a spring integrally associated with the key tab and arranged to be deflected when the key tab is downwardly depressed about the hinge axis, to resist such depression by engagement with an undersurface on a housing, (e) and a housing carrying socket means to receive said hinge which has the form of trunnion structure nestable against edges defined by said socket means, said under surface on the housing engageable by said spring urging said trunnions against said edges.

11. The combination of claim 10 wherein the key tab has a forward end portion spaced generally above the hinge and defining a stop abutting an exposed shoulder of the housing structure to limit upward pivoting of the key tab.

* * * * *